US011634973B2

(12) United States Patent
Park et al.

(10) Patent No.: US 11,634,973 B2
(45) Date of Patent: Apr. 25, 2023

(54) DYNAMIC STRAIN DETECTION FOR CABLE ORIENTATION DURING PERFORATION OPERATIONS

(71) Applicant: Halliburton Energy Services, Inc., Houston, TX (US)

(72) Inventors: Brian Vandellyn Park, Spring, TX (US); Mikko Jaaskelainen, Katy, TX (US); Ira Jeffrey Bush, Los Angeles, CA (US)

(73) Assignee: Halliburton Energy Services, Inc., Houston, TX (US)

( * ) Notice: Subject to any disclaimer, the term of this patent is extended or adjusted under 35 U.S.C. 154(b) by 44 days.

(21) Appl. No.: 17/275,130

(22) PCT Filed: Oct. 4, 2018

(86) PCT No.: PCT/US2018/054449

§ 371 (c)(1),
(2) Date: Mar. 10, 2021

(87) PCT Pub. No.: WO2020/072065

PCT Pub. Date: Apr. 9, 2020

(65) Prior Publication Data

US 2022/0049587 A1 Feb. 17, 2022

(51) Int. Cl.
*E21B 43/116* (2006.01)
*E21B 43/119* (2006.01)
(Continued)

(52) U.S. Cl.
CPC ..... *E21B 43/119* (2013.01); *E21B 43/116* (2013.01); *E21B 47/09* (2013.01); *E21B 47/135* (2020.05)

(58) Field of Classification Search
CPC .... E21B 43/116; E21B 43/117; E21B 43/119; E21B 47/024; E21B 47/09; E21B 47/135
See application file for complete search history.

(56) References Cited

U.S. PATENT DOCUMENTS 5,211,714 A 5/1993 Jordan et al.
8,028,751 B2 10/2011 Pinto et al.
(Continued)

FOREIGN PATENT DOCUMENTS

GB 2596485 A * 12/2021 ..... E21B 43/116
WO WO-2010136764 A2 * 12/2010 ..... E21B 43/11857
(Continued)

*Primary Examiner* — Daniel P Stephenson
(74) *Attorney, Agent, or Firm* — John Wustenberg; Parker Justiss, P.C.

(57) ABSTRACT

A method of perforating a wellbore is provided. The method includes generating a shockwave that propagates throughout said wellbore by firing a perforation device at a perforating direction, and measuring the shockwave at a fiber optic cable in the wellbore using the fiber optic cable. The method further includes determining an orientation of the fiber optic cable relative to the perforating direction based on the shockwave and the perforating direction, and changing the perforating direction based on the orientation of said the optic cable for a subsequent perforation of the wellbore to minimize damage to the fiber optic cable during the subsequent perforation. The fiber optic cable is an existing cable that has been deployed before the method starts.

20 Claims, 8 Drawing Sheets

(51) Int. Cl.
*E21B 47/09* (2012.01)
*E21B 47/135* (2012.01)

(56) References Cited

U.S. PATENT DOCUMENTS

| | | | | |
|---|---|---|---|---|
| 9,617,848 | B2 | 4/2017 | Hill et al. | |
| 9,945,215 | B2 * | 4/2018 | Godfrey | E21B 47/0224 |
| 11,131,168 | B2 * | 9/2021 | Badii | E21B 43/119 |
| 2013/0329522 | A1 | 12/2013 | Skinner et al. | |
| 2014/0208843 | A1 | 7/2014 | Godfrey | |
| 2017/0153355 | A1 * | 6/2017 | Little, III | G01V 8/16 |
| 2017/0275975 | A1 * | 9/2017 | Hardesty | E21B 43/117 |
| 2018/0052252 | A1 | 2/2018 | Farhadiroushan et al. | |
| 2020/0018149 | A1 * | 1/2020 | Luo | E21B 47/12 |
| 2022/0049587 | A1 * | 2/2022 | Park | E21B 47/09 |

FOREIGN PATENT DOCUMENTS

| | | | |
|---|---|---|---|
| WO | 2017105434 | A1 | 6/2017 |
| WO | 2020072065 | A1 | 4/2020 |

* cited by examiner

DYNAMIC STRAIN DETECTION FOR CABLE ORIENTATION DURING PERFORATION OPERATIONS

CROSS-REFERENCE TO RELATED APPLICATION

This application is the National Stage of, and therefore claims the benefit of, International Application No. PCT/US2018/054449 filed on Oct. 4, 2018, entitled "DYNAMIC STRAIN DETECTION FOR CABLE ORIENTATION DURING PERFORATION OPERATIONS," which was published in English under International Publication Number WO 2020/072065 on Apr. 9, 2020. The above application is commonly assigned with this National Stage application and is incorporated herein by reference in its entirety.

BACKGROUND

After drilling various sections of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore by pumping a cement slurry through the casing and into the annulus between the casing and the formation. To produce fluids into the casing string, hydraulic openings or perforations must be made through the casing string, the cement sheath, and a short distance into the formation.

Typically, these perforations are created by a perforating tool connected along a tool string that is lowered into the cased wellbore by a tubing string, wireline, slickline, coiled tubing, or other conveyance. Once the perforating tool is properly oriented and positioned in the wellbore adjacent the formation to be perforated, the perforating tool is actuated to create perforations through the casing and cement sheath into the formation.

It is sometimes desirable to perforate a well in a particular direction. For example, where one or more cables have been permanently deployed downhole adjacent the casing, it is desirable to avoid damaging the cables during perforating. The cables transmit power, real-time data or control signals to or from surface equipment and downhole devices such as transducers and control valves.

BRIEF DESCRIPTION

Reference is now made to the following descriptions taken in conjunction with the accompanying drawings, in which.

DETAILED DESCRIPTION

Figure 1:
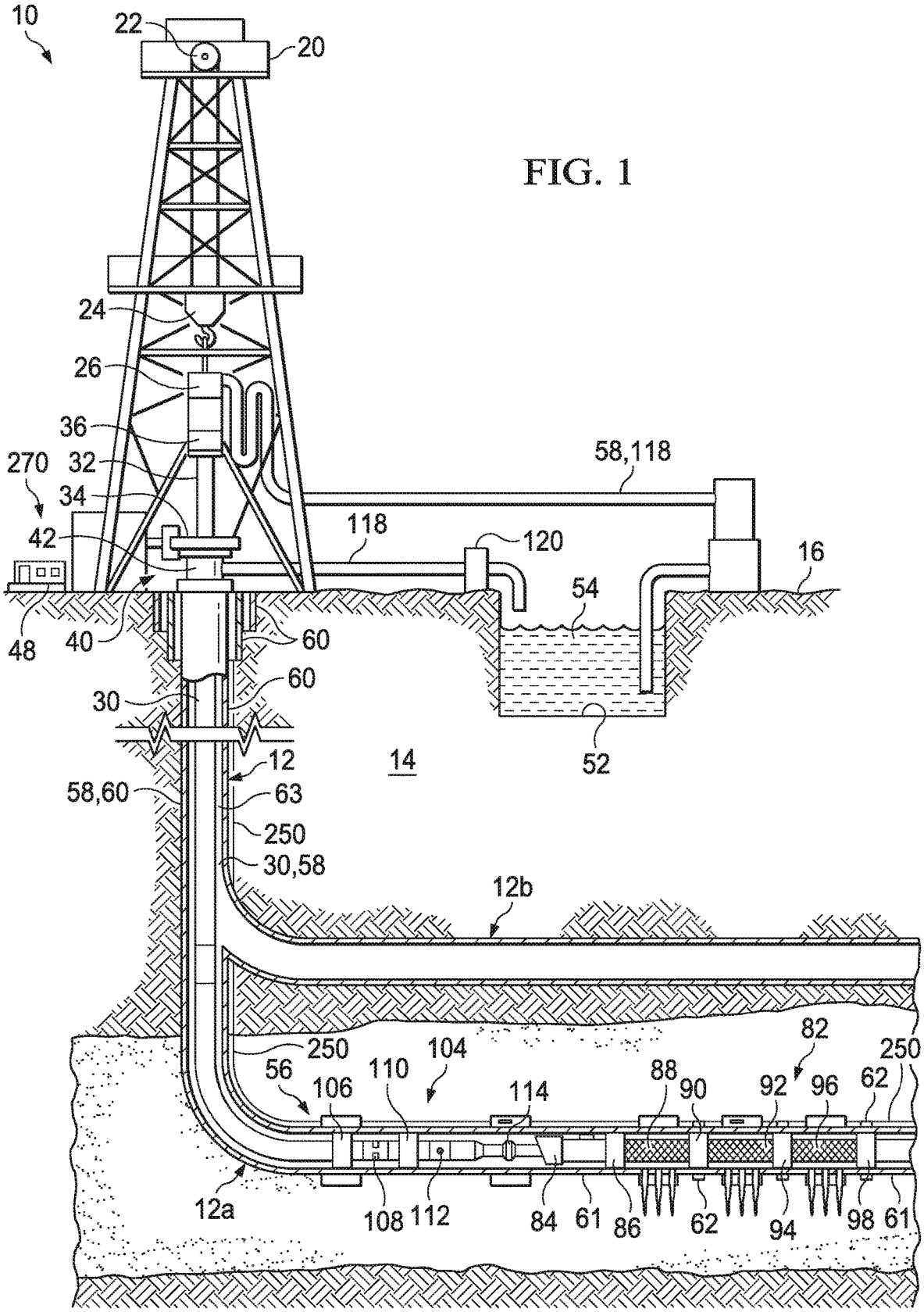
FIG. 1 illustrates an elevation view of an embodiment of a land-based well system with a system for minimizing cable damage due to perforating operations.

Current practice is to provide extra protection to the cable by deploying the fiber optic cable between metal bumper bars. The bumper bars protect the fiber optic cable during Run-In-Hole (RIH) and the bumper bars can be used to detect the location of the fiber optic cable. Detecting is based on electrical and/or magnetic sensing technologies where short pulses may be transmitted from inside the casing and any metal mass may alter the detected response. Blast protectors and cable clamps may also be used to protect the cable and/or may also be used for detecting the orientation of the fiber optic cable.

The challenge with this approach is that the cable orientation survey is costly and time consuming. A special tool must be deployed where the tool is periodically moved along the wellbore, and the sensing head of the tool must be rotated 360 degrees while taking measurements. This information is then used to map the cable location based on the sensor data. Special perforation guns are then used, where the gun string can be locked in place inside the casing, and the guns can be rotated away from the mapped location of the fiber optic sensing cable.

Alternative approaches using orientation devices have been proposed. One of such approaches attaches a sensor package to the fiber optical cable where the sensor package contains, e.g., accelerometers that can be used to measure the relative orientation of the cable, and acoustically transmit the data to a fiber optic cable. The acoustic information is recorded using e.g. a Distributed Acoustic Sensing (DAS) interrogator system at the surface where the acoustic information is converted into orientation information vs. sensor locations along the cable. This would eliminate the need for a dedicated cable orientation survey and eliminate the cost. It would, however, increase the system complexity and the sensor packages may have limited life, which would pose a problem for Drilled but UnCompleted (DUC) wells where the well is drilled and completed but not perforated at the time when it is completed. It may in many cases be several months or even years before the well is perforated.

Introduced herein are methods and systems that use existing, e.g., already deployed cables, to determine the position of the cable and orient the perforation direction away from the cable so that the damage to fiber optic cables during perforation operation can be eliminated. Instead of logging the cable or using a special tool, the introduced method utilizes the shockwave generated from the perforation operation. Recognizing that the cable is least affected when it is 90 or 270 degrees from the charge direction, the introduced method first determines the orientation of the fiber optic cable by measuring shockwave responses to charges at various angles at the toe, i.e., the end of the wellbore, and identifying the zones where the response is minimal. From the identified zones, the introduced method determines the location of the fiber optic cable with respect to the perforation gun and, for successive charges uphole, rotates the gun to be 90 or 270 degrees from the fiber optic cable. As the perforation operation progresses, more data for determining the positon of the cable would become available and the introduced method can be adjusted to the gradual rotation of the cables along the wellbore.

The introduced approach eliminates the need for logging the cable location or using a special tool for monitoring the cable orientation. The introduced approach also eliminates the need for dedicated blast protectors that are used for cable location determination. As such, the introduced approach significantly reduces the time, equipment and people on location, and can reduce the Total Cost of Ownership (TCO) for installed fiber optic systems by more than 15%.

Figure 2:
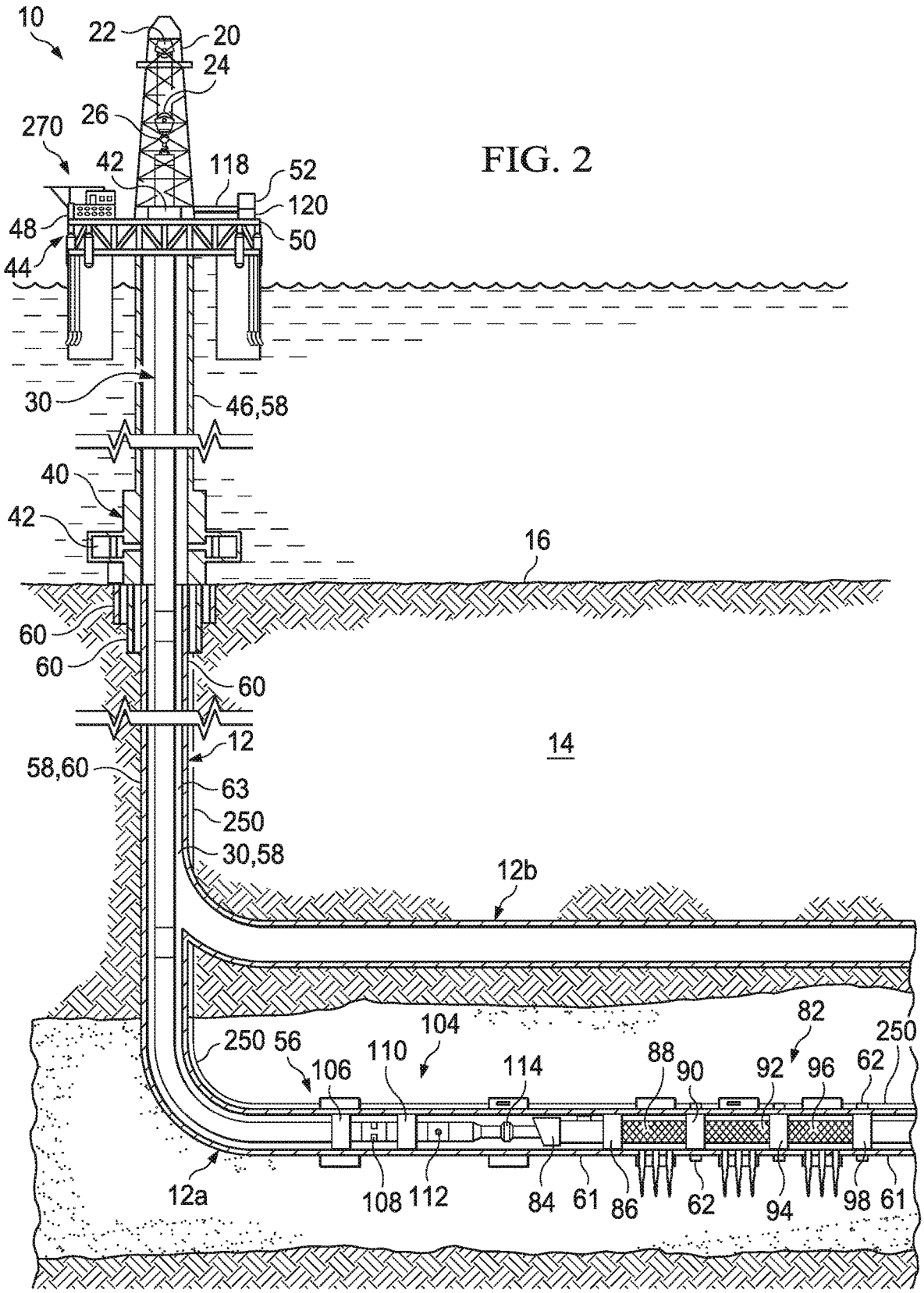
FIG. 2 illustrates an elevation view of an embodiment of a marine-based well system with a system for minimizing cable damage due to perforating operations.

FIGS. 1 and 2 show elevation views of partial cross-sections of a wellbore production system 10 utilized to produce hydrocarbons from a wellbore 12 extending through various earth strata in an oil and gas formation 14 located below the earth's surface 6. The wellbore 12 may be formed of a single or multiple bores 12*a*, 12*b*, . . . 12*n*, extending into the formation 14, and disposed in any orientation, such as horizontal wellbores 12*b* illustrated in FIGS. 1 and 2.

The production system 10 includes a rig or derrick 20. The rig 20 may include a hoisting apparatus 22, a travel block 24, and a swivel 26 for raising and lowering casing, drill pipe, coiled tubing, production tubing, other types of pipe or tubing strings or other types of conveyance vehicles 30 such as wireline, slickline, and the like. In FIG. 1, the conveyance vehicle 30 is a substantially tubular, axially extending drill string formed of a plurality of pipe joints coupled together end-to-end, while in FIG. 2, the conveyance vehicle 30 is a completion tubing supporting a completion assembly as described below. The rig 20 may include a kelly 32, a rotary table 34, and other equipment associated with rotation and/or translation of the conveyance vehicle 30 within a wellbore 12. For some applications, the rig 20 may also include a top drive unit 36.

The rig 20 may be located proximate to a wellhead 40 as shown in FIG. 1, or spaced apart from wellhead 40, such as in the case of an offshore arrangement as shown in FIG. 2. One or more pressure control devices 42, such as blowout preventers (BOPs) and other equipment associated with drilling or producing a wellbore may also be provided at wellhead 40 or elsewhere in the system 10.

For offshore operations, as shown in FIG. 2, the rig 20 may be mounted on an oil or gas platform 44, such as the offshore platform as illustrated, semi-submersibles, drill ships, and the like (not shown). Although the system 10 of FIG. 2 is illustrated as being a marine-based production system, the system 10 of FIG. 2 may be deployed on land. Likewise, although the system 10 of FIG. 1 is illustrated as being a land-based production system, the system 10 of FIG. 1 may be deployed offshore. In any event, for marine-based systems, one or more subsea conduits or risers 46 extend from the deck 50 of the platform 44 to a subsea wellhead 40, a tubing string 30 extends down from the rig 20, through a subsea conduit 46 and the BOP 42 into the wellbore 12.

In FIG. 1, a working or service fluid source 52, such as a storage tank or vessel, may supply a working fluid 54 pumped to the upper end of tubing string 30 and flow through tubing string 30. Working fluid source 52 may supply any fluid utilized in wellbore operations, including without limitation, drilling fluid, cementitious slurry, acidizing fluid, liquid water, steam or some other type of fluid. Fluids, cuttings and other debris returning to surface 16 from wellbore 12 are directed by a flow line 118 to storage tanks 52 and/or processing systems 120, such as shakers, centrifuges and the like.

Production system 10 may generally be characterized as having a pipe system 58. For purposes of this disclosure, the pipe system 58 may include casing, risers, tubing, drill strings, completion or production strings, subs, heads or any other pipes, tubes or equipment that couples or attaches to the foregoing, such as a tubing string, the conduit, collars, and joints, as well as the wellbore 12 and laterals in which the pipes, casing and strings may be deployed. In this regard, the pipe system 58 may include one or more casing strings 60 that may be cemented in the wellbore 12, such as the surface, intermediate and production casings 60 shown in FIG. 1. An annulus 63 is formed between the walls of sets of adjacent tubular components, such as concentric casing strings 60 or the exterior of tubing string 30 and the inside wall of wellbore 12 or casing string 60, as the case may be.

In each of FIGS. 1 and 2, the subsurface equipment 56 is illustrated as a completion equipment, disposed in a substantially horizontal portion of the wellbore 12 with the casing string 60 cemented in the wellbore 12, which includes casing sections 61 connected with casing connectors or collars 62. A lower completion assembly 82 is disposed in the casing string 60 and includes various tools such as an orientation and alignment subassembly 84, a packer 86, a sand control screen assembly 88, a packer 90, a sand control screen assembly 92, a packer 94, a sand control screen assembly 96 and a packer 98.

Disposed in the wellbore 12 at the lower end of tubing string 30 and uphole from the lower assembly 82 is an upper completion assembly 104. The upper completion assembly 104 includes various tools such as a packer 106, an expansion joint 108, a packer 110, a fluid flow control module 112 and an anchor assembly 114.

Referring still to FIGS. 1 and 2, a control system 270 may be deployed to communicate with sensing cables 250 and function as a source for transmitting a signal downhole. The control system 270 may be located at the surface 16, e.g., on the platform 44 of a control station 48. In the illustrated embodiment, the sensing cables 250 include a fiber optic cable, and the control system 270 includes an interrogation unit (FIG. 4) that sends optic waves down the fiber optical cable, and processes the resulting return signals. It is understood that the control system 270 may include different types of sensing cables (optic or otherwise). It is also understood that the cables 250 may also be an electrical cable and the control system 270 may transmit and receive electrical signals along the cables 250.

The sensing cables 250 are strapped to outside of the casing 60. The sensing cable 250 extend from the surface 16 (FIG. 1) or the platform 44 (FIG. 2) downhole through the portion of the wellbore 12 to be perforated. The sensing cables 250 may extend all the way to the bottom of the casing string 60. The sensing cables 250 may operate as communication media, to transmit power, or data and the like between a surface controller (not shown) and the upper and lower completion assemblies 104, 82, respectively. The sensing cables 250 may also operate to monitor various devices and operations including, but not limited to, cement curing, perforating, fracturing, injection, fluid inflow, production, and well integrity.

It is common to cement a casing in place for unconventional wells, and then make pathways into the formation to allow hydrocarbons to migrate from the formation into the well bore. It is common to hydraulically fracture the formation in sections, where pathways are made using perforation gun assembly that penetrates through the casing and cement and into the formation. The perforation gun assembly is removed from the wellbore after a stage has been perforated, and frack fluid and proppant is pumped during the fracture operation. Each of the perforated zones may be exposed to fluids at high pressure to generate fractures in the formation and there may be proppant in the fluid to keep these fractures open. Each of the sections may be isolated by plugs deployed inside the casing after a stage has been hydraulically fractured. The perforation gun assembly is then deployed again at the start of the next fracturing stage. Each of the stages will be individually perforated.

Figure 3:
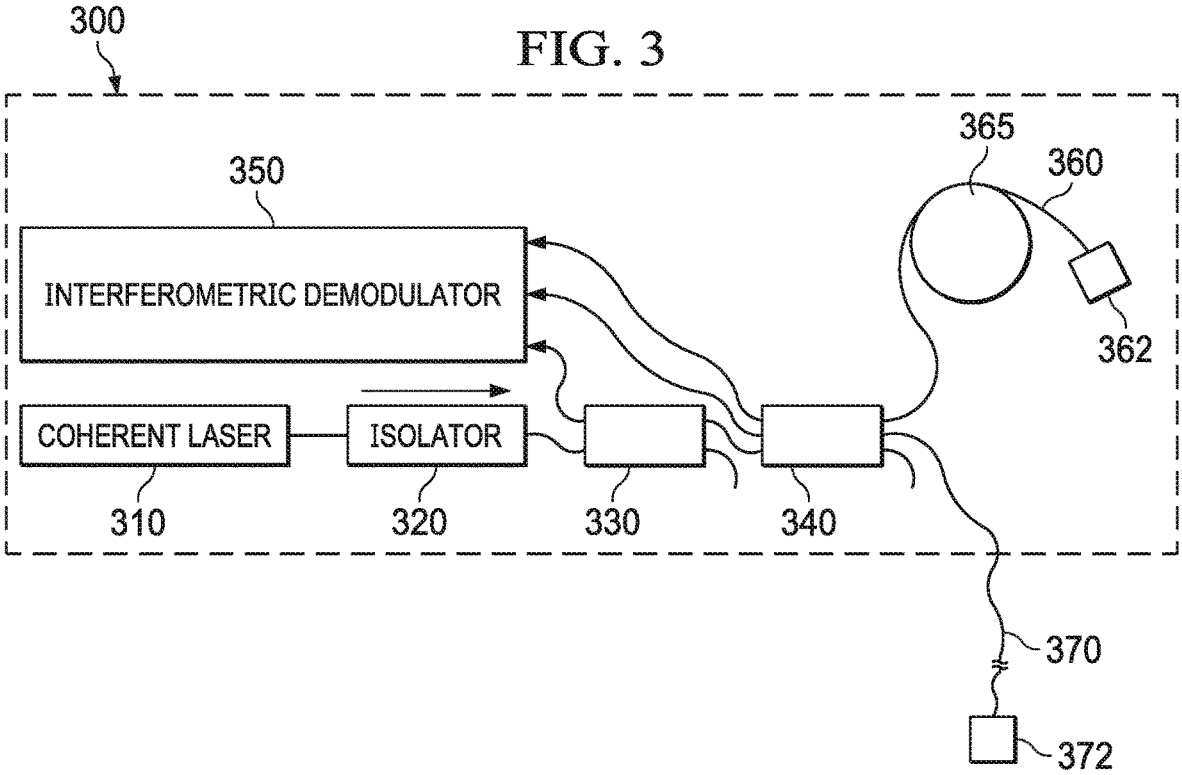
FIG. 3 illustrates a block diagram of an embodiment of an interrogator unit.

FIG. 3 illustrates a block diagram of an embodiment of an interrogator unit 300. The interrogation unit 300 may be located within a control system such as the control system 270 in FIGS. 1 and 2. In the illustrated embodiment, the unit 300 runs high-speed continuous wave using a coherent laser 310 and an isolator 320. The high speed (up to few MHZ) continuous wave operation provides for temporal segregation of the initial shock signal from the subsequent resulting traveling waves along the casing to measure the radial blast signature patterns. The unit 300 may also run different types of interferometry, such as those using a pulsed or chirped wavelength/frequency.

The unit 300 further includes a 2×2 coupler 330, a 3×3 coupler 340 and an interferometric demodulator 350 that work in concert to perform (high speed) homodyne demodulation. The demodulator 350 extracts the dynamic strain information at the fiber optic cable using the signals returned from a reference fiber 360 and the downhole fiber 370.

In the illustrated embodiment, the unit 300 functions as a Michelson fiber interferometer, utilizing "DAS" fiber (usually single mode) as the downhole fiber 370. The reference fiber 360 is contained within the unit 300 and is coupled with a reference delay 365. The reference 360 and downhole fibers 370 have reflectors 362 and 372 at their respective ends. The lengths L1 and L2 of the downhole 370 and reference fiber 360 are sufficiently balanced for high fidelity measurements (perhaps a few hundred meters). The length of the reference fiber 360 may change based on the length of the downhole fiber 370, which may be different for different applications.

It is understood that while the homodyne demodulation approach is illustrated in FIG. 3, other demodulation approaches are possible. The other approaches, however, require injection of a carrier signal that shifts the information to sidebands and involve a more complicated interrogation implementation that incurs high priced parts, substantially more power consumption, higher operational signal bandwidths, and a higher noise floor than the homodyne approach.

It is also understood that the wavelength for the light source 310 and the narrow wavelength reflectors 362, 364 at the end of the fiber optic cables 360, 370 is different from the wavelength used for DAS measurements. This allows the interrogation unit 300 to use the same fiber optic cables for measuring the strain/shockwave on the fiber optic cables during perforation operations and also during fracture stimulation and production monitoring operations, which use the DAS measurements. It is even possible that all these operations may be carried out simultaneously using the same fiber optic cables.

Figure 4:
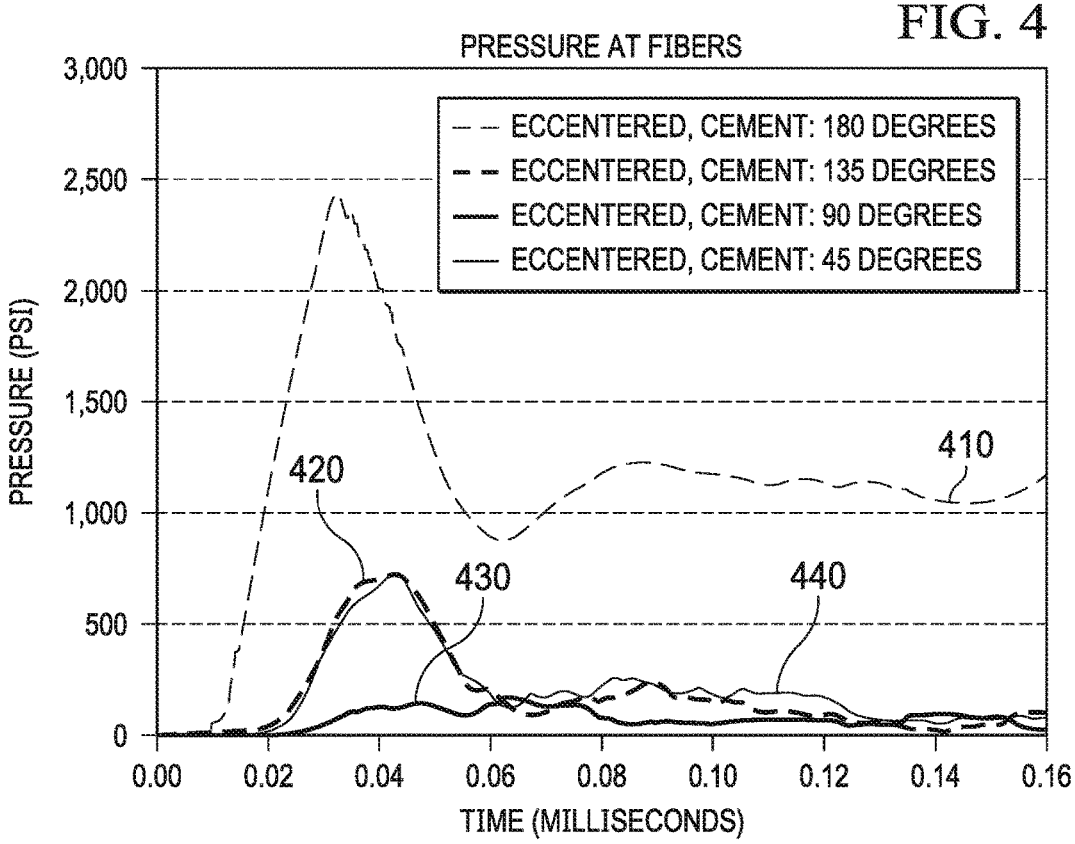
FIG. 4 illustrates pressure measurements from a simulation of an exemplary perforation operation.

FIG. 4 illustrate pressure measurements from a simulation of an exemplary perforation operation. First measurements 410 represent simulated pressure of the shockwave at a fiber optic cable when the fiber optic cable is oriented 180 degrees from the perforation direction, second measurement 420 represents the pressure when the fiber optic cable is oriented 135 degrees, third measurement 430 represents the pressure when the fiber optic cable is oriented 90 degrees, and fourth measurement 440 represents the pressure when the fiber optic cable is oriented 45 degrees.

Figure 5:
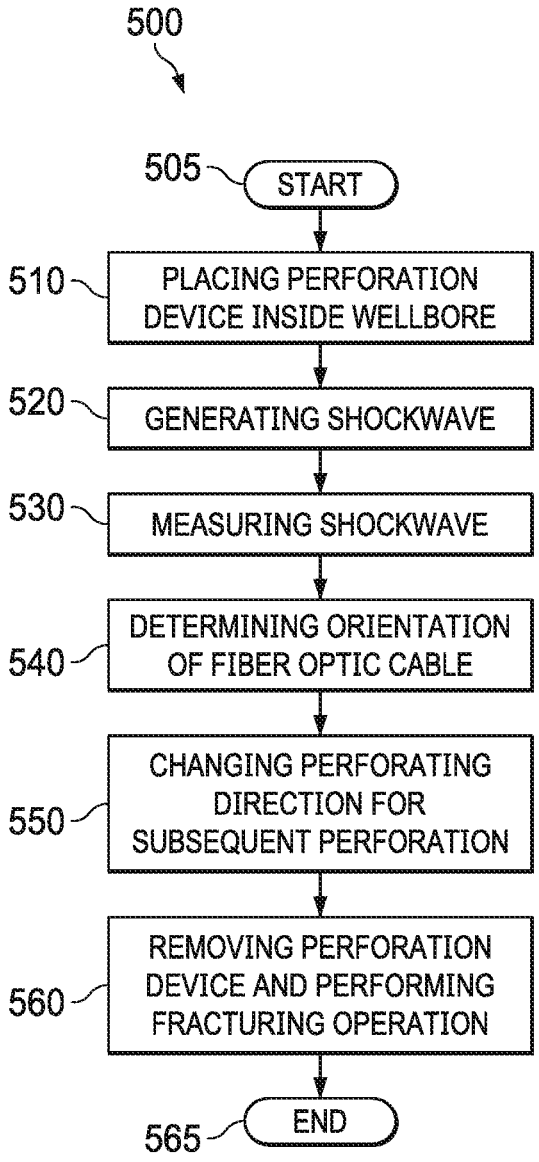
FIG. 5 illustrates a flow chart of an embodiment of a perforation method that minimizes cable damage due to perforating operations.

As shown, the simulated pressure, which is indicative of the strain at the fiber optic cable, is greatest when the charge is fired from 0 or 180 degrees from the fiber optic cable and the least when fired from 90 degrees. FIG. 5 illustrates a flow chart of an embodiment of a perforation method 500 that is based on this counterintuitive principle. The method starts at step 505.

Figure 6:
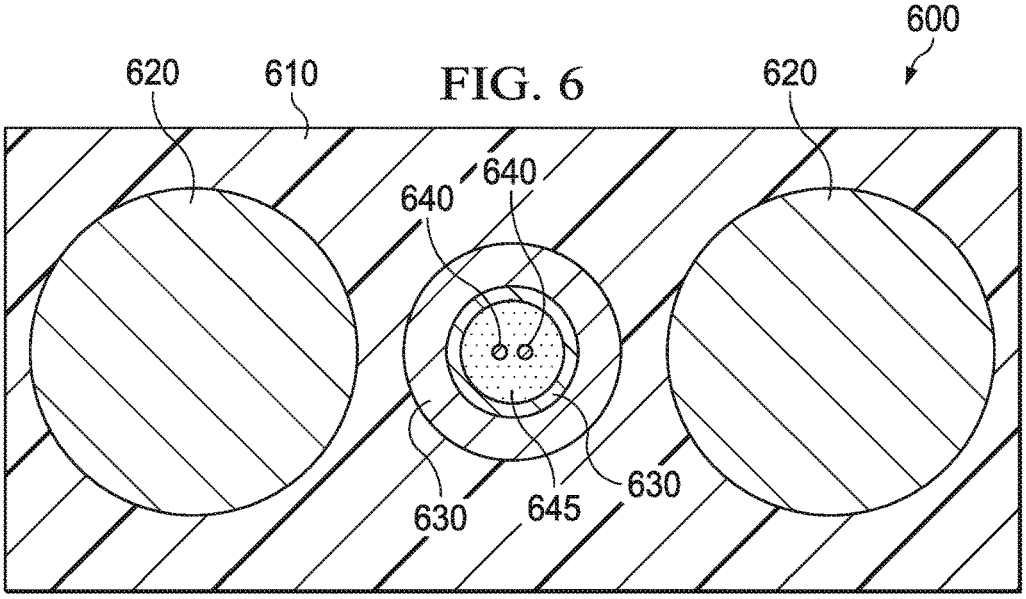
FIG. 6 illustrates a cross-sectional view of an embodiment of sensing cables packaged as a flatpack.

At the step 505, the wellbore has already been drilled and the casings have been placed therein. Fiber optic cables also have been already deployed and coupled to an outside of the casings as a part of sensing cables such as the sensing cables 250 in FIGS. 1 and 2, that run along the length of the casings. One embodiment of the sensing cables, a flatpack 600, is illustrated in FIG. 6. The flatpack 600 includes an encapsulation 610 that encapsulates and protects bumper bars 620 and stainless steel tubes 630 that further encapsulate and protect fiber optic cables 640. The steel tubes 630 are generally filled with gel 645 to protect the fiber optic cables 640 from water and other chemicals such as Hydrogen that may react with dopants in the fiber optic cables 640 and cause optical attenuation.

Referring back to the method 500, a perforation assembly including one or more perforation guns, is placed inside the wellbore at step 510. The perforation device may be lowered into the wellbore using a tubing string, wireline, slickline, coiled tubing or other conveyance. For the initial perforation, a perforation device is placed at the end of the casing to limit the possible damage of the initial perforation to the distal end of the fiber optic cable. For subsequent perforations, the perforation device would be moved to a different location along the casing.

Figure 7:
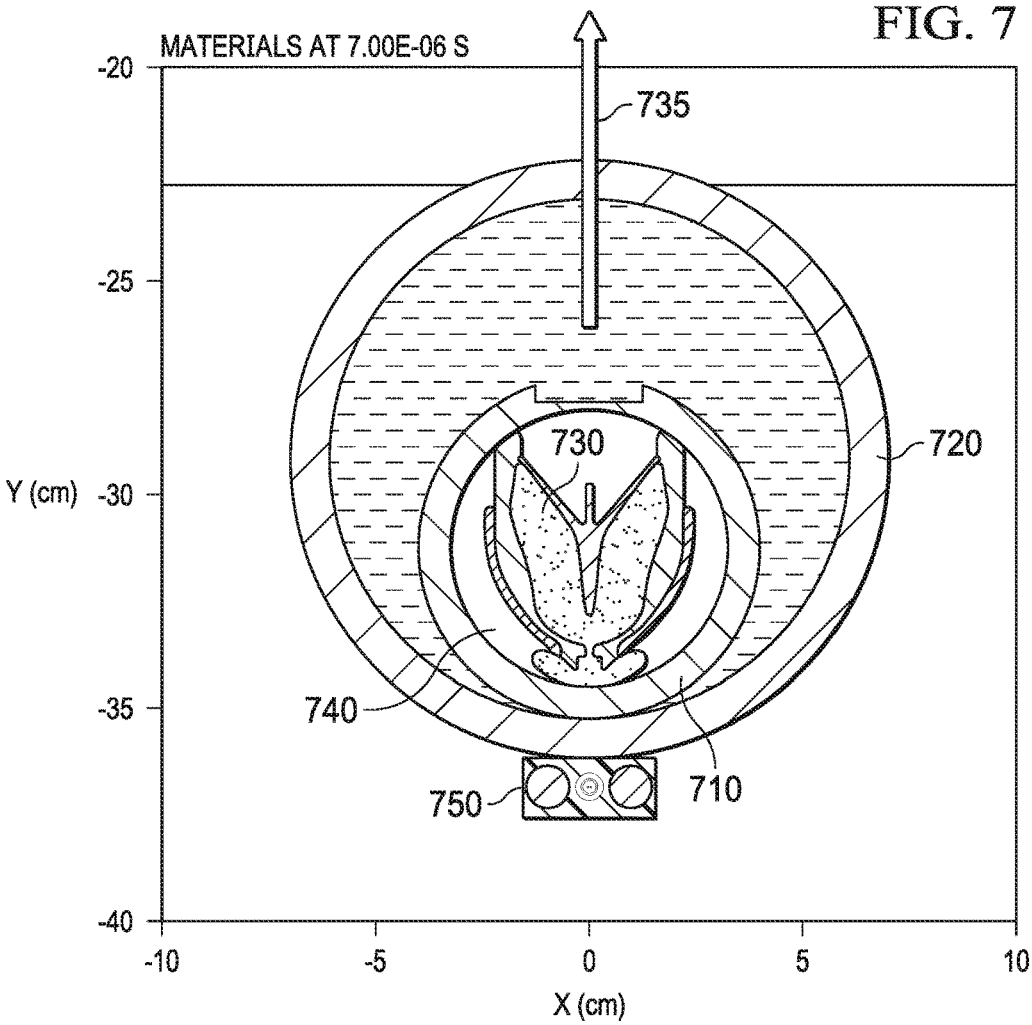
FIG. 7 illustrates a cross sectional view of an embodiment of a perforation device placed inside a wellbore.

FIG. 7 illustrates a cross sectional view of an embodiment of a perforation device 710 in a casing 720 after the step 510. In the illustrated embodiment, the perforation device 710 is placed inside the casing 720 at an eccentered position and includes a charge tube 740 that contains a charge 730 directed at a direction 735. A flatpack 750 such as the flatpack 600 in FIG. 6 is cemented onto the casing 720. The flatpack 750 may be clamped to the casing 720.

Figure 8:
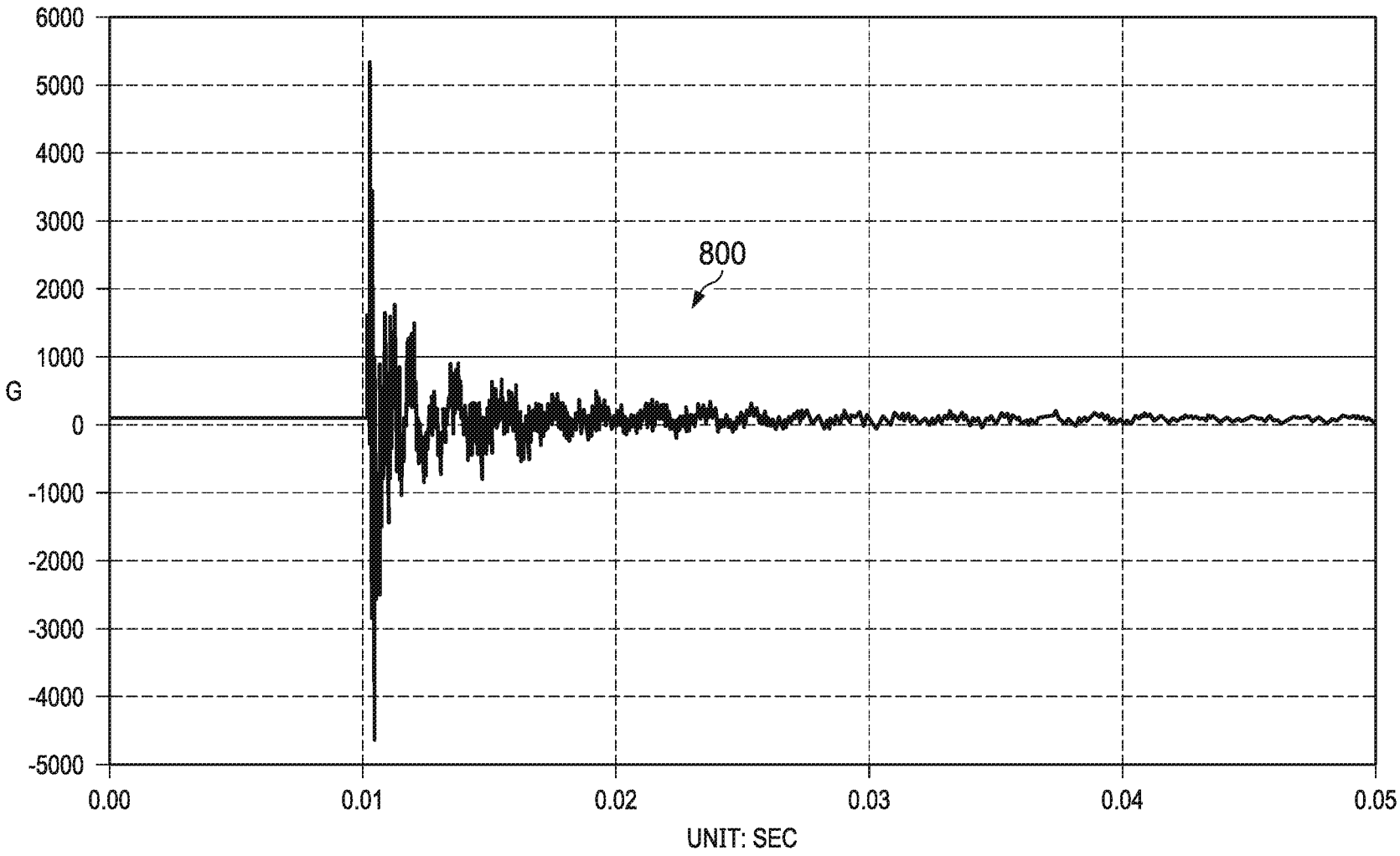
FIG. 8 illustrates an example of pyro shockwave generated by a perforation device.

At step 520, a shockwave/acoustic wave is generated by using the perforation device. The generated shockwave propagates throughout the casing and the wellbore. In one embodiment, the generated shockwave is pyrotechnic shockwave such as the pyro shockwave 800 illustrated in FIG. 8. As shown, the pyro shockwave 800 is typically characterized by high peak acceleration, high frequency content, and short duration. The shape of the curve is largely dependent on the source type and strength, the structure of the body receiving the shock, and especially the distance from the source to the response point of interest.

Figure 9A:
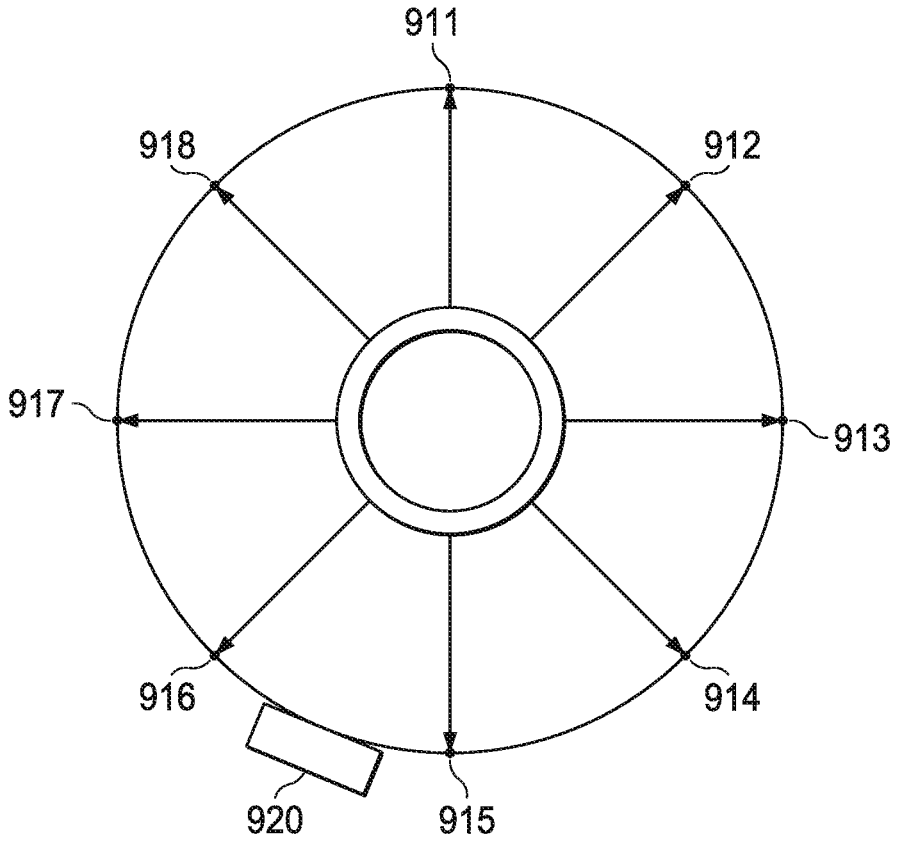
FIG. 9A illustrates an exemplary instance of an initial perforation, in which multiple charges at various orientations are fired.

FIG. 9A illustrates an exemplary instance of the initial perforation, in which multiple charges at various orientations are fired. In the illustrated embodiment, eight (8) charges 911, 912, 913, 914, 915, 916, 917, 918 are fired sequentially 45 degrees from each other. It is understood that multiple shots may be fired at close vicinity, e.g., 1-2 or 12-24 inches apart, at each direction. At this point the location of a flatpack 920 is unknown.

At step 530, using the fiber optic cables, the generated shockwave is measured. The shockwave may be measured by an interrogator unit, e.g., the interrogator unit 300 in FIG.

3, using existing, e.g., deployed during the completion, fiber optic cables. As fiber optic cables already deployed in the wellbore, e.g., fiber optic cables for DAS measurements, is used to measure the shockwave from the perforation, the step 530 does not require an additional/separate downhole equipment, such as the special survey tool or the sensor package used in other practices. The shockwave may be measured using various types of interferometry, including those use a pulsed or chirped wavelength/frequency.

Figure 9B:
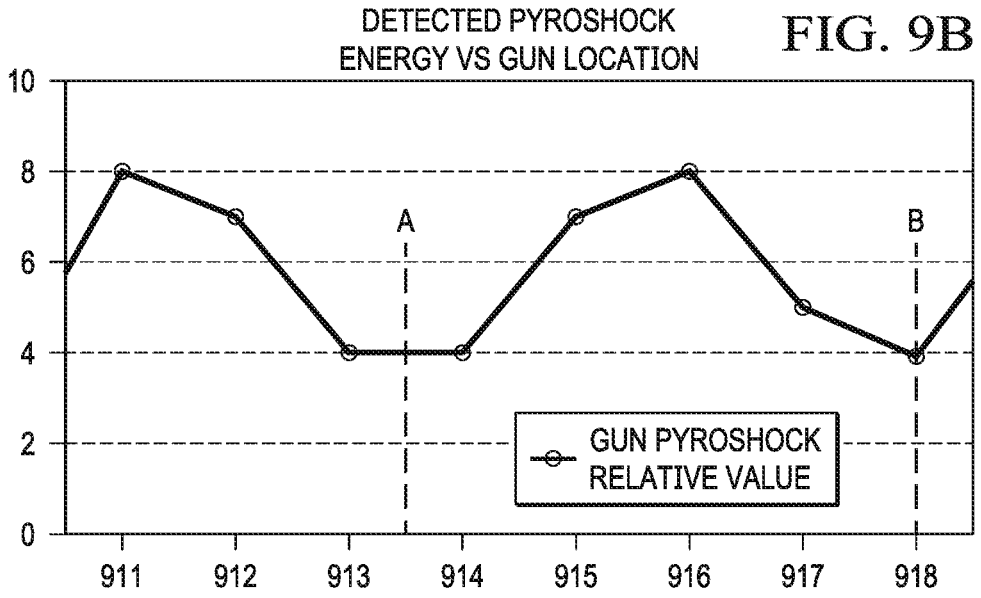
FIG. 9B illustrates a line chart of relative pyroshock energy values in the instance of FIG. 9A.

Due to the symmetry of the shockwave, the measurements from two charge directions, 180 degrees from each other, have the minimum values. A line chart of the relative pyroshock energy values measured by the flatpack 920 in FIG. 9A is illustrated in FIG. 9B. The charges 913 and 914, and 918 represents directions A and B that generated the least amount of the shockwave to the flatpack 920.

Figure 9C:
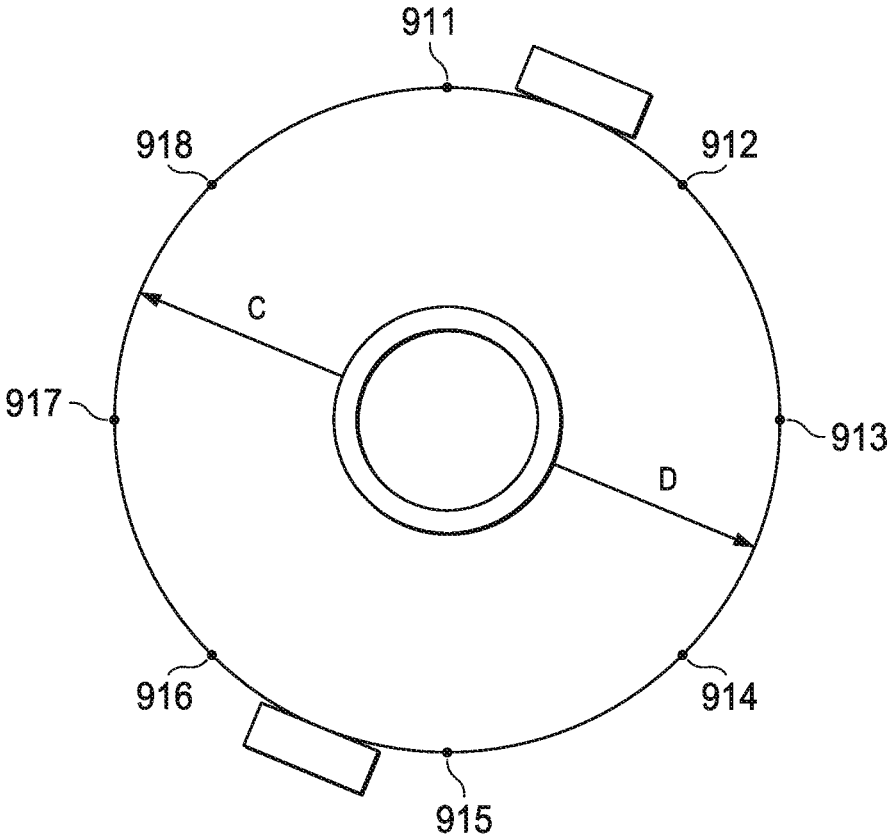
FIG. 9C illustrates possible flatpack locations and perforation directions for a subsequent perforation operation determined from the line chart in FIG. 9B.

At step 540, an orientation of the fiber optic cable relative to the perforation directions is determined based on the shockwave measured at the step 530. The orientation of the fiber optic cable may be determined by a processor of a control system, such as the control system 270, which may be a part of the interrogation unit. Knowing that the shockwave is minimized at 90 degrees from the charge direction, one can determine the fiber optic cable's location to be 90 degrees from to the charge directions that generated the minimum shock values. In the instance of FIGS. 9A and B, the location of the flatpack 920 would be between the charge directions 915 and 916 or between 911 and 912, which are 90 degrees from the directions A and B. This is shown in FIG. 9C. It is understood that other factors such as the eccentricity of the perf gun, and the type of attachment between the fiber optic cable and the casing, e.g., clamped or cemented, can be taken into account at the step 540.

At step 550, the perforating direction of the perforation device for the next perforation is changed based on the location of the fiber optic cable determined at the step 540. In other words, the perforation device would be oriented 90 degrees from the location of the fiber optic cable determined at the step 540. In FIG. 9C, such direction would be direction C or D, depending on the preference of the operator. The perforating direction may be changed by the perforation assembly. The perforation assembly may be motorized to orient the perforation device away from the fiber optic cable or mounted at different angles and gravity-oriented.

At step 560, the perforation device is removed from the casing and the wellbore and fracturing operation is performed. The step 560 may also include setting a fracturing plug to isolate the current fracturing stage from the next fracturing stage. The fracturing plug would be at the end of the perforation string.

The steps 510-560 are repeated for each fracturing stage. It is understood that for subsequent fracturing stages, the fiber optic cable location from the previous stage can be used instead of performing the initial perforation. For example, since the fiber optic cable rotates gradually along the length of the casing, e.g., 180 degrees to 360 degrees over a horizontal section of 3,000 to 6,000 ft, the perforation gun can be rotated a small amount, e.g., from about 5 degrees to as about 30 degrees, to both directions from the previous orientation to detect the direction of the rotation of the cable. If the amplitude of the shockwave stays the same in each direction, then the position and orientation of the perforation gun is correct; if the amplitude decreases in one direction then the orientation (rotation direction) of the perf gun is corrected to that one direction; and if the amplitude increases one direction then the direction is corrected the other direction. This way, the direction in which the cable is rotating can be detected and be accommodated accordingly. When all fracturing stages are perforated and fractured, the method 500 ends at step 565.

Those skilled in the art to which this application relates will appreciate that other and further additions, deletions, substitutions and modifications may be made to the described embodiments.

The above-described apparatuses, systems or methods or at least a portion thereof may be embodied in or performed by various processors, such as digital data processors or computers, wherein the processors are programmed or store executable programs or sequences of software instructions to perform one or more of the steps of the methods or functions of the apparatuses or systems. The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods or functions of the system described herein.

Certain embodiments disclosed herein or features thereof may further relate to computer storage products with a non-transitory computer-readable medium that has program code thereon for performing various computer-implemented operations that embody at least part of the apparatuses, the systems, or to carry out or direct at least some of the steps of the methods set forth herein. Non-transitory medium used herein refers to all computer-readable media except for transitory, propagating signals. Examples of non-transitory computer-readable medium include, but are not limited to: magnetic media such as hard disks, floppy disks, and magnetic tape; optical media such as CD-ROM disks; magneto-optical media such as floptical disks; and hardware devices that are specially configured to store and execute program code, such as ROM and RAM devices. Examples of program code include both machine code, such as produced by a compiler, and files containing higher level code that may be executed by the computer using an interpreter.

Various aspects of the disclosure can be claimed including the apparatuses, systems, and methods disclosed herein. Aspects disclosed herein include:

A. A method of perforating a wellbore, comprising: generating a shockwave that propagates throughout the wellbore by firing a perforation device at a perforating direction; measuring the shockwave at a fiber optic cable in the wellbore using the fiber optic cable, the fiber optic cable being an existing cable; determining an orientation of the fiber optic cable relative to the perforating direction based on the shockwave and the perforating direction; and changing the perforating direction based on the orientation of the fiber optic cable for a subsequent perforation of the wellbore to minimize damage to the fiber optic cable during the subsequent perforation.

B. A system for perforating a wellbore, comprising: a perforation assembly configured to generate a shockwave that propagates throughout the wellbore by firing a perforation device at a perforating direction; an interrogator unit including a fiber optic cable deployed in the wellbore and configured to use the fiber optic cable to measure the shockwave at the fiber optic cable, the fiber optic cable being an existing cable; and a processor configured to determine an orientation of the fiber optic cable relative to the perforating direction based on the shockwave and the perforating direction; wherein the perforation assembly is further configured to change the perforating direction based on the orientation of the fiber optic cable for a subsequent perforation of the wellbore to minimize damage to the fiber optic cable during the subsequent perforation.

Each of aspects A and B can have one or more of the following additional elements in combination:

Element 1: further comprising placing the perforation device inside the wellbore. Element 2: wherein the placing includes placing the perforation device at a distal end of a casing in the wellbore for an initial perforation. Element 3: wherein the placing includes moving the perforation device to a different location inside the wellbore for the subsequent perforation. Element 4: wherein the changing includes orienting the perforation device to be 90 degrees from the orientation of the fiber optic cable. Element 5: wherein the fiber optic cable is deployed during a run in hole. Element 6: wherein the generating includes generating multiple shockwaves by firing the perforation device sequentially at multiple directions, and the determining includes using at least one of the multiple directions that generated a minimum shock value at the fiber optic cable. Element 7: wherein the changing includes changing the perforating direction based on an orientation of the fiber optic cable in a previous fracturing stage. Element 8: wherein the determining includes using an interferometry. Element 9: wherein the determining is based further on an eccentricity of the perforation device. Element 10: wherein the perforation device is placed inside the wellbore. Element 11: wherein the perforation device is placed at a distal end of a casing in the wellbore for an initial perforation. Element 12: wherein the perforation device is moved to a different location inside the wellbore for the subsequent perforation. Element 13: wherein the perforation assembly is further configured to change the perforating direction to be 90 degrees from the orientation of the fiber optic cable for the subsequent perforation. Element 14: wherein the fiber optic cable is deployed during a run in hole. Element 15: wherein the perforation assembly is further configured to generate multiple shockwaves by firing the perforation device sequentially at multiple directions, and the processor is further configured to use at least one of the multiple directions that generated a minimum shock value at the fiber optic cable to determine the orientation of the fiber optic cable. Element 16: wherein the perforating direction is changed for the subsequent perforation based on an orientation of the fiber optic cable in a previous fracturing stage. Element 17: wherein the interrogator unit is further configured to use an interferometry. Element 18: wherein the processor is further configured to determine the orientation of the fiber optic cable based on an eccentricity of the perforation device.

What is claimed is:

1. A method of perforating a wellbore, comprising:

generating, in at least one perforation stage, at least one shockwave that propagates throughout said wellbore by firing a perforation device at a perforating direction;

measuring said shockwave at a fiber optic cable in said wellbore using said fiber optic cable, said fiber optic cable being an existing cable;

determining an orientation of said fiber optic cable relative to said perforating direction based on said shockwave and said perforating direction; and changing said perforating direction based on said orientation of said fiber optic cable for a subsequent perforation stage of said wellbore to minimize damage to said fiber optic cable during said subsequent perforation stage, wherein said changing includes orienting said perforation device to be 90 degrees from said orientation of said fiber optic cable.

2. The method of claim 1 further comprising placing said perforation device inside said wellbore.

3. The method of claim 2, wherein said at least one perforation stage is an initial perforation stage and said placing includes placing said perforation device at a distal end of a casing in said wellbore for the initial perforation stage.

4. The method of claim 3, wherein said placing includes moving said perforation device to a different location inside said wellbore for said subsequent perforation stage.

5. The method of claim 1, wherein said fiber optic cable is deployed during a run in hole.

6. The method of claim 1, wherein said generating includes generating multiple shockwaves by firing said perforation device sequentially at multiple directions, and said determining includes using at least one of said multiple directions that generated a minimum shock value at said fiber optic cable.

7. The method of claim 1, wherein said determining said orientation is based on multiple shockwaves and corresponding perforating directions from multiple perforation stages.

8. The method of claim 1, wherein said measuring includes using interferometry.

9. The method of claim 1, wherein said determining is based further on an eccentricity of the perforation device.

10. A system for perforating a wellbore, comprising:

a perforation assembly configured to generate a shockwave in a perforation stage that propagates throughout said wellbore by firing a perforation device at a perforating direction;

an interrogator unit including a fiber optic cable deployed in said wellbore and configured to use said fiber optic cable to measure said shockwave at said fiber optic cable, said fiber optic cable being an existing cable; and a processor configured to determine an orientation of said fiber optic cable relative to said perforating direction based on said shockwave and said perforating direction;

wherein said perforation assembly is further configured to change said perforating direction to be 90 degrees from said orientation of said fiber optic cable for a subsequent perforation stage of said wellbore to minimize damage to said fiber optic cable during said subsequent perforation stage.

11. The system of claim 10, wherein said perforation device is placed inside said wellbore.

12. The system of claim 11, wherein said perforation stage is an initial perforation stage and said perforation device is placed at a distal end of a casing in said wellbore for the initial perforation stage.

13. The system of claim 12, wherein said perforation device is moved to a different location inside said wellbore for said subsequent perforation.

14. The system of claim 10, wherein said fiber optic cable is deployed during a run in hole.

15. The system of claim 10, wherein said perforation assembly is further configured to generate multiple shockwaves by firing said perforation device sequentially at multiple directions, and said processor is further configured to use at least one of said multiple directions that generated a minimum shock value at said fiber optic cable to determine said orientation of said fiber optic cable.

16. The system of claim 10, wherein said perforating direction is changed for said subsequent perforation stage based on an orientation of the said fiber optic cable in a previous fracturing stage.

17. The system of claim 10, wherein said interrogator unit is further configured to use interferometry.

18. The system of claim 10, wherein said processor is further configured to determine said orientation of said fiber optic cable based on an eccentricity of the perforation device.

19. A method of perforating a wellbore, comprising:

generating, in at least one perforation stage, at least one shockwave that propagates throughout said wellbore by firing a perforation device at a perforating direction;

measuring said shockwave at a fiber optic cable in said wellbore using said fiber optic cable, said fiber optic cable being an existing cable;

determining an orientation of said fiber optic cable relative to said perforating direction based on multiple shockwaves and corresponding perforating directions from multiple perforation stages; and changing said perforating direction based on said orientation of said fiber optic cable for a subsequent perforation stage of said wellbore to minimize damage to said fiber optic cable during said subsequent perforation stage.

20. The system of claim 19, wherein said changing includes orienting said perforation device to be 90 degrees from said orientation of said fiber optic cable.

* * * * *